United States Patent [19]

Barkan

[11] 4,110,582

[45] Aug. 29, 1978

[54] STORED-ENERGY OPERATING DEVICE FOR AN ELECTRIC CIRCUIT BREAKER

[75] Inventor: Philip Barkan, Media, Pa.

[73] Assignee: General Electric Company, Philadelphia, Pa.

[21] Appl. No.: 702,328

[22] Filed: Jul. 2, 1976

[51] Int. Cl.[2] ..... H01H 3/00

[52] U.S. Cl. ..... 200/153 SC; 74/2; 185/37; 192/33 R

[58] Field of Search ..... 200/153 SC; 185/37, 185/40 R; 192/33; 74/2

[56] References Cited

U.S. PATENT DOCUMENTS

| | | | |
|---|---|---|---|
| 2,909,628 | 10/1956 | McCloud | 200/153 SC |
| 3,410,381 | 11/1968 | Henshaw et al. | 192/33 |
| 3,689,721 | 9/1972 | McGuffie | 200/153 SC |
| 3,876,847 | 4/1975 | Dykes | 200/153 SC |
| 3,905,247 | 9/1975 | Cook | 192/33 R |

*Primary Examiner*—Harold J. Tudor
*Attorney, Agent, or Firm*—William Freedman

[57] ABSTRACT

An operating device for an electric circuit breaker comprises a closing spring and a rotatable spring-controller mounted for rotation between first and second dead-center positions with respect to the spring. The spring is charged by transmitting rotational forces to the spring-controller through a pawl mounted on the spring controller and an abutment on a rotatable driving member. Cam means is provided for releasing the pawl from driven engagement with the abutment at the end of a spring-charging operation. Circuit-breaker closing is effected by allowing the spring quickly to discharge after a charging operation.

Discharge of the spring carries the spring-controller into said second dead-center position and produces oscillations of the spring-controller immediately following such discharge. The cam means holds the pawl out of a collision path with respect to said abutment during such oscillations, even if such oscillations should carry the spring-controller through as much as 90° of reverse travel from its second dead-center position.

12 Claims, 4 Drawing Figures

STORED-ENERGY OPERATING DEVICE FOR AN ELECTRIC CIRCUIT BREAKER

BACKGROUND

This invention relates to a stored-energy operating device and, more particularly, to a stored energy operating device which is especially suited for high-speed closing of an electric circuit breaker.

The invention is more specifically concerned with improvements in the general type of stored-energy operating device disclosed in U.S. Pat. Nos. 2,829,737—Favre and 2,909,629—McCloud. The operating devices disclosed in these patents each comprises a heavy spring which is charged by the action of a small electric motor rotating a spring-controlling member into a dead-center position with respect to the spring. Rotation of the spring-controlling member is continued until it reaches a predetermined position past dead center, where it is held by suitable releasable stop means. When the stop means is released, the heavy spring, which had been charged, quickly discharges, and this discharging action is utilized to produce closing of the circuit breaker.

To prevent damage to the parts of the device when the spring-controller is driven against the above-described stop after charging of the spring, a releasable coupling must be provided between the motor and the spring-controller. In my operating device, this releasable coupling takes the form of a pawl-and-abutment drive that is operated in the following manner. After the spring has been charged and just prior to the instant that said stop is encountered by the spring-controller, the motor is deenergized and the pawl is released from the cooperating abutment, thus uncoupling the motor from the spring-controller and allowing the motor to coast to a halt without interference from the aforesaid stop.

SUMMARY

An object of my invention is to protect this pawl-and-abutment drive from damage during a subsequent spring-discharge operation and to provide such protection despite variations in the amount of coasting by the motor after the above-described uncoupling.

In the type of stored-energy device described above, the spring, upon discharging to close the circuit breaker, drives the spring-controller in a forward direction into a second dead-center position that is angularly spaced 180° from the first dead-center position. Any excess energy remaining after this operation carries the spring-controller in a forward direction past said second dead-center position, thus partially recharging the spring. Immediately after this partial recharging, the spring again discharges, driving the spring-controller in a reverse direction through said second dead-center to partially recharge the spring. These oscillations of the spring-controller about said second dead-center continue at high speed, but with decreasing amplitude, until the excess energy is finally dissipated and the spring-controller comes to rest at said second dead-center position.

A problem presented by these oscillations is that under certain conditions they can carry the spring-controller in a reverse direction through a sufficient excursion to produce a collision between the pawl and abutment unless special precautions against such collisions are provided.

Another object of my invention is to protect the pawl-and-abutment drive from such collisions despite such oscillations, even oscillations sufficient to carry the spring-controller into positions where a collision might otherwise occur.

In carrying out the invention in one form, I provide an operating device comprising a spring, a rotatable spring-controller mounted for rotation between first and second dead-center positions with respect to said spring, and means for transmitting charging forces to the spring in response to rotation of the spring-controller in a forward direction toward said first dead-center position. The spring acts to discharge and thereby further rotate the spring-controller in a forward direction when the spring-controller has been rotated in a forward direction past said first dead-center position. Releasable stop means blocks said further forward rotation of the spring-controller and can be released subsequently to permit the spring to rapidly discharge and continue forward rotation of the spring-controller into said second dead-center position. Immediately following this rapid discharge of the spring, the spring-controller oscillates about said second dead-center position.

Means is provided for forwardly rotating the spring-controller from said second to said first dead-center position thereby charging the spring. This means comprises a rotatable driving member for the spring-controller having an abutment thereon and a pawl mounted on the spring-controller and arranged to be driven by the abutment when the driving member is driving the spring-controller in a forward direction toward said first dead-center position. Cam means effective after the spring-controller has passed in a forward direction through the first dead-center position but before the stop means has become effective to block forward motion of the spring-controller is provided for releasing the pawl from driven relationship with the abutment so that the driving member is not imparting driving force to the pawl when the stop means is blocking the spring-controller. This cam means normally acts during the aforesaid oscillations immediately following spring-discharge to hold said pawl out of a path that will permit a collision between said pawl and said abutment even if the spring-controller, in oscillating about said second dead-center position, should travel as much as 90° in a reverse rotational direction from said second toward said first dead-center position.

BRIEF DESCRIPTION OF DRAWINGS

For a better understanding of the invention, reference may be had to the following drawings, wherein.

DETAILED DESCRIPTION OF PREFERRED EMBODIMENT

Figure 1:
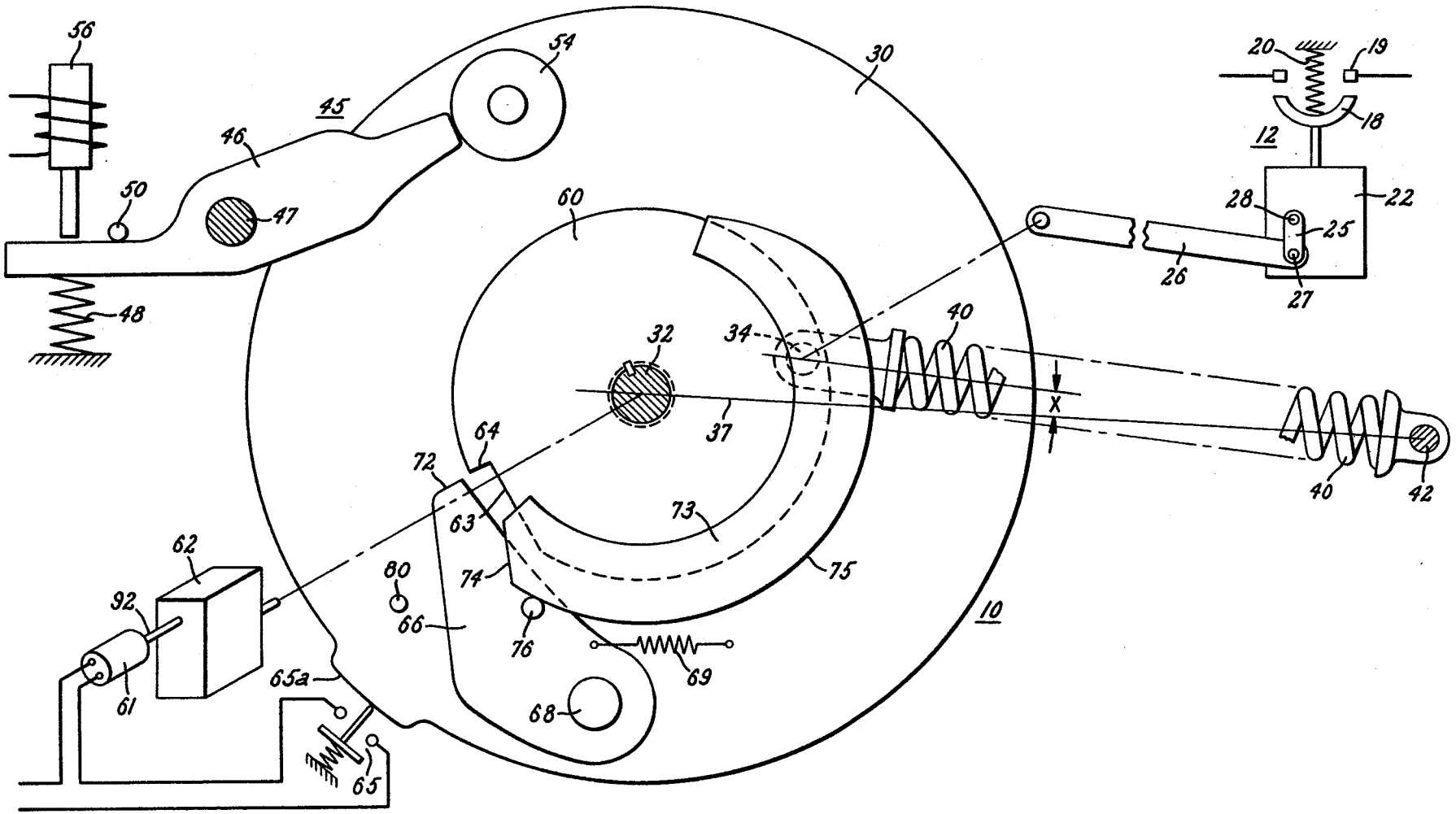
FIG. 1 is a schematic showing of my operating device depicting the parts in a position where the spring is fully charged and the charging motor is coasting to a halt immediately following its deenergization. The circuit breaker is shown in an open position.

Referring now to FIG. 1, the stored-energy operating device is shown at 10 and the circuit breaker which it is designed to close is shown at 12. This circuit breaker can be of any conventional type and is therefore shown in schematic form only.

THE CIRCUIT BREAKER 12

As shown in FIG. 1, the circuit breaker 12 comprises a pair of relatively movable contacts 18 and 19. One of these contacts 18 is a movable bridging contact biased to its open position of FIG. 1 by a suitable circuit-breaker opening spring 20. Closing forces are transmitted to the movable contact by a conventional mechanically trip-free operating mechanism 22 shown in block form only. An example of such a mechanism is shown in more detail at 12 in the aforesaid U.S. Pat. No. 2,829,737—Favre.

Operating force is supplied to the mechanism 22 through a crank 25 and a link 26 pivotally connected to the crank at 27. Crank 25 is keyed to a rotatable shaft 28 having a fixed axis and suitably coupled to the mechanism 22. When crank 25 is rotated in a clockwise direction about the axis of shaft 28 from its position of FIG. 1 to its position of FIG. 2, the operating mechanism 22 acts to close the contacts 18, 19. The trip-free character of the operating mechanism enables the circuit breaker to open in response to an electric fault on the power line even if the crank 25 is held in its position of FIG. 2. In addition, the mechanism is so designed that crank 25 can be returned from its position of FIG. 2 to its position of FIG. 1 without affecting the operating mechanism or the contacts.

THE STORED-ENERGY OPERATING DEVICE 10

For driving link 26 from its position of FIG. 1 to the left to produce the above-described closing of the circuit breaker, the stored-energy operating device 10 is relied upon. This operating device 10 comprises a rotatable flywheel 30, occasionally referred to herein as a spring-controller. Flywheel 30 is freely rotatable on a centrally located shaft 32 and includes a crank pin 34 fixed thereto at a point spaced radially from the axis of the shaft 32. The above described link 26 is pivotally connected to this crank pin 34.

Cooperating with flywheel 30 is a heavy compression spring 40 that has one end pivotally connected to crank pin 34 and its other end pivotally mounted on a stationary pivot 42. Flywheel 30 has two different dead-center positions with respect to spring 40. In a first one of these dead-center positions, the axis of crank pin 34 is located between the axis of shaft 32 and the axis of pivot pin 42 and on a reference line 37 interconnecting these latter two axes. In a second one of these dead-center positions, the axis of crank pin 34 is located on the same reference line 37 but on the opposite side of the axis of shaft 32.

In FIG. 1 the parts are depicted in a position wherein the crank pin 34 has been driven in a counterclockwise, or forward, direction past the first dead-center position. Spring 40 is essentially fully charged and is biasing flywheel 30 in a counterclockwise direction but is blocked from discharging by a releasable stop 45. This releasable stop 45 comprises a prop latch 46 that is pivotally mounted on a stationary pivot 47. A compression spring 48 biases prop latch 46 into a set position against a fixed stop 50. In FIG. 1 the prop latch 46 is positioned in interfering relationship with a roller 54 carried by flywheel 30. Release of stop 45 is effected by means of a solenoid 56, which upon energization drives prop latch 46 in a counterclockwise direction out of interfering relation with roller 54.

Figure 2:
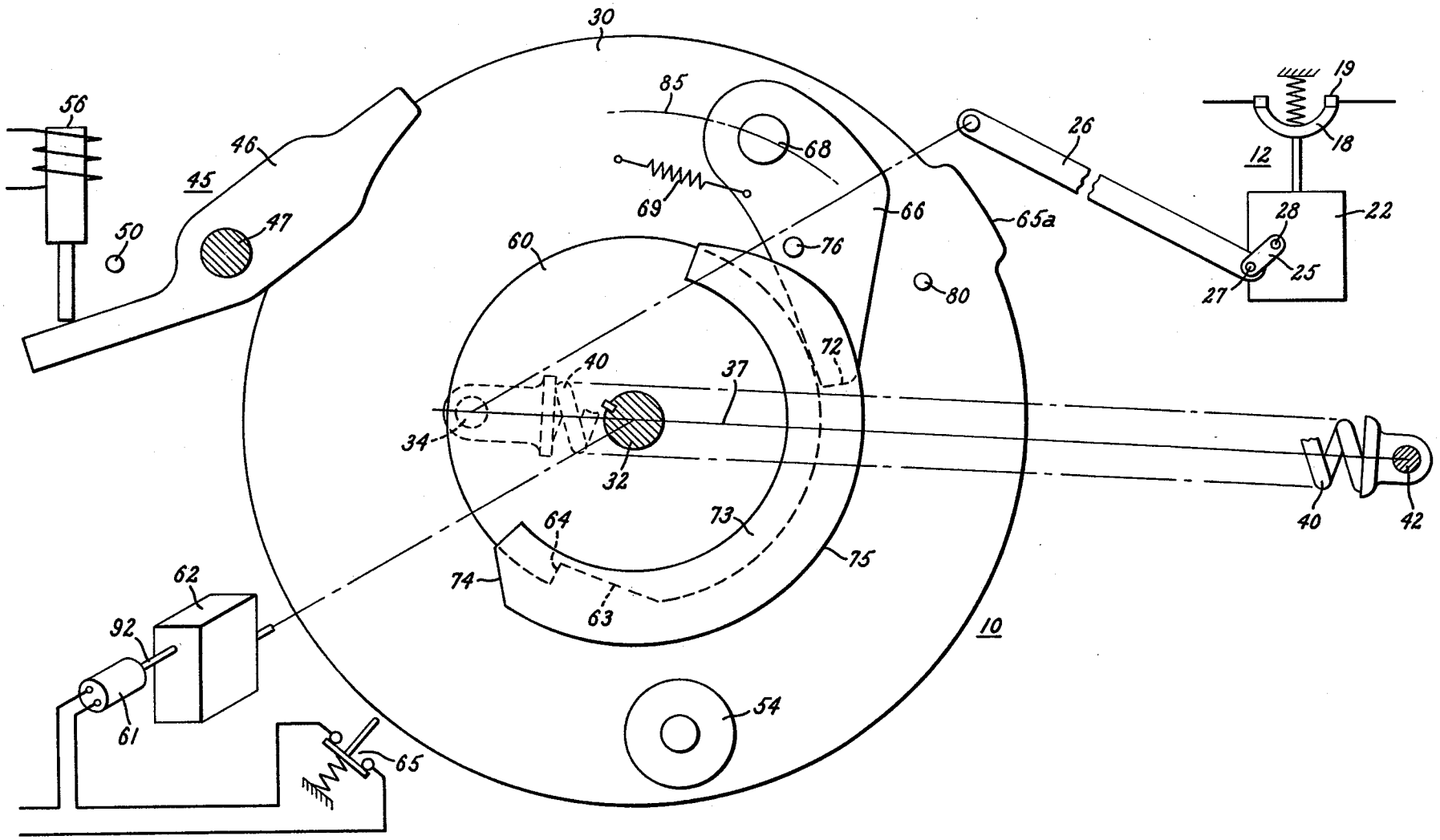
FIG. 2 is a schematic showing depicting the parts immediately after the spring has discharged and effected closing of the circuit breaker.

When stop 45 is thus released, main compression spring 40 is free to drive flywheel 30 in a counterclockwise direction from its position of FIG. 1 into its second dead-center position, which is shown in FIG. 2. This counterclockwise motion of flywheel 30 is transmitted to link 26 through crank pin 34 and acts to drive link 26 through a circuit-breaker closing stroke.

Compression spring 40 is recharged after the above-described discharge by driving flywheel 30 in a counterclockwise, or forward, direction from its position of FIG. 2 into its position of FIG. 1. During this recharging motion, the connecting link 26 moves to the right from its position of FIG. 2 into its position of FIG. 1, but this motion of link 26 has no effect on the mechanism 22 of the circuit breaker, as noted hereinabove. For driving flywheel 30 through this recharging motion, a rotatable driving member 60 is provided. This driving member 60 is keyed to the shaft 32 on which the flywheel is freely rotatably mounted. Shaft 32 is coupled to a small electric motor 61 through conventional reduction gearing 62. The motor is controlled in a conventional manner by a suitable control circuit (not shown), the operation of which will soon appear more clearly.

Driving member 60 has a circular periphery except for a notch 63 provided therein, which notch results in an abutment 64 being present on the driving member 60. This abutment 64 cooperates with a pawl 66 carried by flywheel 30. Pawl 66 is pivotally mounted on a pin 68 fixed to flywheel 30 and is biased in a clockwise direction about pin 68 by a suitable spring 69. The pawl has a working surface 72 that under certain conditions is engageable with abutment 64 to transmit driving motion between driving member 60 and flywheel 30. When driving member 60 is rotated in a counterclockwise direction from its position of FIG. 2, no driving force is transmitted to the flywheel 30 until the abutment 64 reaches a position of angular alignment with working surface 72 on the pawl. When this position is reached, the pawl is in notch 63 and the abutment 64 engages the working surface 72 of the pawl and thereafter transmits driving force through the pawl to flywheel 30, thus producing counterclockwise spring-charging motion of the flywheel.

This counterclockwise spring-charging motion of the flywheel 30 is continued for slightly more than 180° until the flywheel is returned to its position of FIG. 1, where it is blocked by the stop 45. Such counterclockwise motion of the flywheel charges spring 40 until the previously-described first dead-center position is reached. Thereafter, flywheel 30 passes in a counterclockwise direction slightly beyond this dead-center position (typically about 10°) and into its overcenter, blocked position of FIG. 1.

RELEASE OF PAWL 66 FROM ABUTMENT 64 BY CAM 73

To prevent damage to the parts of the device when roller 54 on flywheel 30 encounters stop 45 after a spring-charging operation, the pawl 66 is released from driven relationship with abutment 64 immediately after the first dead-center position has been reached but just prior to the roller's engaging the prop latch 46. Such release of pawl 66 is effected by cam means comprising a stationary cam member 73 of generally arcuate form. The outer surface 74 of this cam member cooperates with a follower pin 76 on pawl 66 and lifts pawl 66 radially outwardly into a retracted position with respect to abutment 64 just before stop 45 is encountered. The parts are depicted in FIG. 1 just after such pawl-release has occurred and at the instant that the roller 54 encounters prop latch 46. Just prior to this instant, the motor 61 is deenergized by a suitable cut-off switch 65 responsive to position of the driving member 60, following which the motor and the driving member 60 coast to a gradual stop. The precise position at which the driving member 60 stops following such coasting is not critical, provided only that it is within the region protected by the cam 73, as will soon appear more clearly. Typically, this final position of the driving member 60 will be 30° to 60° past the position shown in FIG. 1. For controlling the cut-off switch 65 as above described, a suitable projection 65*a* is provided on the periphery of flywheel 30.

OSCILLATIONS OF FLYWHEEL 30 AT THE END OF A CLOSING OPERATION

When the stop 45 is released to initiate closing of the circuit breaker 12, the spring 40 drives spring-controller 30 counterclockwise into its position of FIG. 2. The amount of excess kinetic energy remaining in the spring-driven parts after this closing operation will depend upon variations in electromagnetic and frictional forces and normal tolerance variations in spring forces. Any such excess energy remaining will carry the flywheel 30 past the dead-center position of FIG. 2 through additional forward rotation, thus partially recharging spring 40. Immediately after this partial recharging, the spring again discharges, this time driving the flywheel in a reverse direction through the dead-center position of FIG. 2 and again partially recharging the spring. Immediately thereafter, the spring again discharges to drive flywheel 30 in a forward direction through the dead-center position of FIG. 2. These oscillations of the flywheel about its dead-center position of FIG. 2 continue at high speed, but with decreasing amplitude, until the excess energy is finally dissipated and the flywheel comes to rest in its dead-center position of FIG. 2.

PROTECTING AGAINST POSSIBLE COLLISIONS RESULTING FROM OSCILLATIONS

A problem presented by these oscillations of the flywheel is that, under certain conditions, they can carry the flywheel in a reverse direction through sufficient travel to produce a damaging collision between the pawl 66 and abutment 64 unless special protection against such collisions is provided. I rely upon the cam 73 as the principal means for providing such protection.

In this respect, when the flywheel 30, in traveling in a reverse direction during such oscillations, carries the follower pin 76 back onto surface portion 75 of the cam 73, the pawl 66 is again retracted counterclockwise about its pivot 68. So long as the pawl is so retracted, its working face 72 cannot engage the abutment 64, and thus damaging collisions between the pawl and the abutment are prevented. The collision-preventing surface 75 of cam 73 (i.e., the constant radius portion of the cam surface that holds the pawl in its retracted position where its working face 72 cannot engage abutment 64) extends around the central axis of the flywheel by about 170°. Thus, even if the above-described oscillations should carry the flywheel through as much as 170° in a reverse direction from its dead-center position of FIG. 2, the cam 73 will be capable of preventing a collision between the pawl 66 and abutment 64 during such reverse travel.

The maximum angular extent of the collision-preventing surface 75 is determined by the angular distance between the two dead-center positions (180°) minus the angle X of FIG. 1 between the first dead-center position and the position of crank pin 34 when the flywheel is blocked by stop 45. Typically, the angle X is about 10°, and this accounts for the 170° figure for the cam referred to hereinabove. In one embodiment of the invention, the maximum observed amplitude of the reverse oscillation, as measured from the second dead-center position, was about 120°. (This occurred when the circuit-breaker closing mechanism 22 was operated toward closed position by operator 10 with the usual trip latch tripped). If the cam maintains the pawl retracted only during such travel, adequate protection against collisions will be provided, but I can provide even greater protection by extending the collision-preventing surface 75 over about 170°. The collision-preventing surface 75 cannot be extended counterclockwise appreciably beyond its terminal position of FIG. 2 since when the flywheel 30 is at rest in its position of FIG. 2, the pawl 66 must be extended, or at least free to move into an extended position, in readiness for being engaged by the abutment 64 during a subsequent normal spring-recharging operation, as will soon be apparent. While it is desirable to extend collision-preventing surface 75 counterclockwise as far as possible consistent with the above requirement, termination of this surface a short distance ahead of the illustrated terminal position introduces little risk of a damaging collision and is therefore tolerable.

The driving member 60 is driven by motor 61 in a counterclockwise direction immediately following the above-described spring-discharge to commence a spring-charging operation. Operation of the motor 60 is initiated automatically by the closing of switch 65 in response to such spring-discharge. A typical position of the driving member 60 at the start of such a recharging operation is shown in FIG. 2. After the driving member 60 has been driven counterclockwise through approximately 135° from its position of FIG. 2, the abutment 64 on the driving member engages the working face 72 of pawl 66 and drives the pawl together with the flywheel 30 through a charging stroke into their position of FIG. 1.

During a recharging operation, motor 61 drives driving member 60 at a relatively low speed compared to the speed of the flywheel during spring-discharge. Typically, several seconds are required before the motor can drive driving member 60 through approximately the $\frac{1}{3}$ to $\frac{1}{2}$ revolution usually required to produce engagement between abutment 64 and pawl 66. This is a sufficiently long period to assure that the above-described oscillations of the closing spring have damped out by the time abutment 64 reaches the pawl and begins transmitting recharging energy from the motor to the spring.

Figure 3:
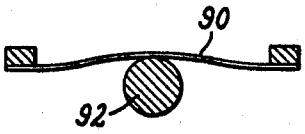
FIG. 3 is a schematic showing of braking means used in the operating device of FIGS. 1 and 2 to limit coasting of the motor and parts driven thereby.
Figure 4:
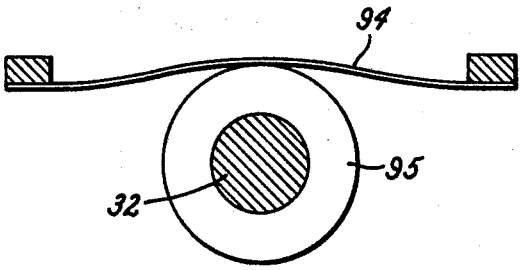
FIG. 4 is a schematic showing of additional braking means for limiting flywheel oscillations.

To provide even greater assurance that the oscillations will have been damped out by the time abutment 64 on the driving member reaches the pawl 66 during a spring-recharging operation, I include in one embodiment of my invention first braking means for reducing coasting of the motor after deenergization and second braking means for hastening the damping-out of the flywheel oscillations. The first braking means, which is shown in FIG. 3, takes the form of a stationary leaf spring 90 rubbing against the motor shaft 92 in the reduction gearing 62. The leaf spring imposes a small frictional load on shaft 92 which opposes and limits coasting of the motor after motor-deenergization. A similar frictional braking device, shown in FIG. 4, as a leaf spring 94 is applied to the hub 95 of flywheel 30 to reduce the amplitude and duration of the flywheel oscillations.

Reduced coasting of the motor after its deenergization results in the abutment 64 being positioned a greater distance from the pawl 66 at the start of a spring-recharging operation, thus allowing more time until the abutment engages the pawl during such recharging operation.

FURTHER PROTECTION AGAINST COLLISIONS RESULTING FROM OSCILLATIONS

It is possible under certain rather remote conditions that the abutment 64 will be in a location outside the protective shield of cam 73 when the above-described oscillations of the driven member are occurring at the end of a spring-discharging operation. Under such conditions, the cam 73 cannot be relied upon to actuate the pawl 66 into its retracted position when the pawl's working face 73 is approaching the abutment 64. A feature of my invention that materially reduces the chances for a damaging collision between the pawl and the abutment under such conditions is the fact that the pawl 66 is carried by the driven member 30 instead of by the driving member 60. In this regard, the driven member 30, being spring driven, moves at high speeds during much of the above-described oscillatory travel. This high-speed motion produces centrifugal force on the pawl 66 that biases the pawl radially outward and during periods of high-speed motion actuates the pawl into its retracted position on the flywheel 30 and holds it retracted, thus reducing the chance for a collision between the pawl and the abutment. A stop 80 on the flywheel prevents excessive retraction of the pawl when it is acted upon by high values of centrifugal force. The spring 69 that biases the pawl toward its extended position is selected so that it has adequate strength to return the pawl to its extended position against the usual frictional opposition but yet is sufficiently weak to allow the pawl to be actuated by centrifugal force into its retracted position when the flywheel is moving at high velocity during the above-described oscillations.

Although there is insufficient centrifugal force to retract the pawl or to hold it retracted when the flywheel is traveling at a low velocity during the above-described oscillations, this is not a significant disadvantage because a collision between the pawl and the abutment presents little chance for damage when the flywheel is moving at a low velocity.

To further aid in retracting the pawl during reverse rotation of the flywheel in the course of the above-described oscillations, I design the pawl in such a way that, when in the position of FIG. 2, its center of gravity is located radially beyond a reference circle 85 that includes the pivot axis of the pawl and has a center coinciding with the central axis of flywheel 30. This location of the pawl's center of gravity causes high tangential acceleration of the flywheel during its reverse movement to produce a radially outward force on the pawl tending to retract it.

While I have shown and described a particular embodiment of my invention, it will be obvious to those skilled in the art that various changes and modifications may be made without departing from my invention in its broader aspects; and I, therefore, intend herein to cover all such changes and modifications as fall within the true spirit and scope of my invention.

What I claim as new and desire to secure by Letters Patent of the United States is:

1. In a stored-energy operating device, (a) a spring, (b) a rotatable spring-controller mounted for rotation between first and second angularly spaced dead-center positions with respect to said spring, (c) means for transmitting charging forces to said spring in response to rotation of said spring-controller in a forward direction toward said first dead-center position, (d) said spring acting to discharge and thereby further to rotate said spring-controller in a forward direction when said spring-controller has been rotated in a forward direction past said first dead-center position, (e) releasable stop means coacting with said spring-controller for blocking said further forward rotation of said spring-controller, said stop means being releasable to permit said spring to rapidly discharge and continue forward rotation of said spring-controller into said second dead-center position, (f) said spring-controller oscillating about said second dead-center position immediately following said rapid discharge of said spring, (g) means for forwardly rotating said spring-controller from said second to said first dead-center position, thereby charging said spring, comprising:

(g1) a rotatable driving member for said spring-controller having an abutment thereon, (g2) a pawl mounted on said spring-controller and arranged to be driven by said abutment when said driving member is driving said spring-controller in a forward direction toward said first dead-center position, (h) and cam means effective after said spring-controller has passed in a forward direction through said first dead-center position but before said stop means has become effective to block forward rotational movement of said spring-controller for releasing said pawl from driven relationship with said abutment so that said driving member is not imparting driving force to said pawl when said stop is blocking said spring-controller, (i) said cam means normally acting during the oscillations immediately following spring-discharge to hold said pawl out of a path that will permit a collision between said pawl and said abutment even if said spring -controller, in oscillating about said second dead-center position, should travel through as much as 90° in a reverse rotational direction from said second toward said first dead-center position.

2. The operating device of claim 1 in which said cam means acts to hold said pawl out of said path of collision with respect to said abutment even if said spring controller, in oscillating about said second dead-center position, should travel through as much as about 120° in a reverse rotational direction from said second toward said first dead-center position.

3. The operating device of claim 1 in which said cam means acts to hold said pawl out of said path of collision with respect to said abutment even if said spring-controller, in oscillating about said second dead-center position, should travel through as much as about 160° in a reverse rotational direction from said second toward said first dead-center position.

4. The operating device of claim 1 in combination with: (a) an electric motor effective when energized to drive said driving member, and (b) means for deenergizing said electric motor immediately after said spring has been charged, thus allowing said driving member to coast to a halt after said pawl has been released from driven relationship with said abutment, said coasting of said driving member consistently terminating when said abutment is in a position wherein said cam means is effective to hold said pawl out of a collision path with respect to said abutment during said oscillations produced by the next discharge of said spring.

5. The operating device of claim 1 in which said pawl is mounted on said spring-controller in such a manner that said oscillations of said spring-controller develop centrifugal forces on said pawl actuating said pawl, if not then already retracted by said cam means, into a retracted position on said spring-controller wherein no damaging collisions can occur between said pawl and said abutment during said oscillations even though said abutment is located during said oscillations in a region unprotected by said cam means from engagement between said pawl and said abutment.

6. The operating device of claim 1 in which said pawl is mounted on said spring-controller in such a manner that said oscillations of said spring-controller develop centrifugal forces on said pawl actuating said pawl, if not then already retracted by said cam means, into a retracted position on said spring-controller located effectively radially outwardly of said abutment, thereby protecting said pawl from damaging collisions with said abutment when said abutment and said pawl effectively angularly register during said oscillations while unprotected by said cam means.

7. The operating device of claim 1 in which:

(a) said pawl has a working surface for engaging said abutment when said driving member is imparting forward driving motion to said spring-controller, (b) said pawl has an extended position on said spring-controller wherein the pawl is effective to engage said abutment when the working surface of said pawl effectively angularly registers with said abutment, (c) said pawl has a retracted position on said spring-controller wherein the pawl is ineffective to engage said abutment when said working surface of the pawl effectively angularly registers with said abutment, and (d) said oscillations of said spring-controller develop forces on said pawl that actuate said pawl into said retracted position on said spring-controller if not then already retracted by said cam means.

8. The operating device of claim 6 in which said oscillation-developed forces of (d) are centrifugal forces effective during high speed reverse motion of said spring-controller to actuate said pawl into said retracted position.

9. The operating device of claim 7 in which:

(a) said pawl is mounted for pivotal motion on said spring-controller about a predetermined pivot axis, said pivotal motion carrying the pawl between its retracted and extended positions, (b) said pawl when in its extended position having its center of gravity located radially outward of a reference circle which has a center coinciding with the axis of rotation of said spring-controller and which extends through said predetermined pivot axis of said pawl.

10. The operating device of claim 1 in combination with means for operating said pawl into a position wherein it is engageable by said abutment when said spring-controller comes to rest in said second dead-center position after spring-discharge, thus allowing said spring-controller to be driven through another spring-charging operation by rotational force transmitted from said driving member to said spring-controller through said abutment and pawl.

11. The operating device of claim 4 in combination with braking means for imposing a load on said motor after deenergization which reduces coasting of said driving member following motor-deenergization.

12. The operating device of claim 4 in combination with braking means for imposing a load on said spring-controller during said oscillations which reduces the duration of the oscillations.

* * * * *